US007913989B2

(12) United States Patent
Sandahl et al.

(10) Patent No.: US 7,913,989 B2
(45) Date of Patent: Mar. 29, 2011

(54) SECTION FOR TRANSPORTING PRINTED PRODUCTS OF VARIABLE CUTOFFS IN A PRINTING PRESS FOLDER

(75) Inventors: Kyle Albert Sandahl, Dover, NH (US); Douglas Joseph Dawley, Dover, NH (US)

(73) Assignee: Goss International Americas, Inc, Durham, NH (US)

( * ) Notice: Subject to any disclaimer, the term of this patent is extended or adjusted under 35 U.S.C. 154(b) by 66 days.

(21) Appl. No.: 12/288,069

(22) Filed: Oct. 16, 2008

(65) Prior Publication Data

US 2010/0095818 A1 Apr. 22, 2010

(51) Int. Cl.
*B65H 5/30* (2006.01)

(52) U.S. Cl. ..... 270/52.17; 270/52.09; 270/42; 270/47

(58) Field of Classification Search ..... 270/52.09, 270/52.17, 13, 5.02, 21.1, 42, 43, 47
See application file for complete search history.

(56) References Cited

U.S. PATENT DOCUMENTS 3,727,911 A * 4/1973 Vits ..... 271/195
3,890,886 A 6/1975 Fessler et al.
3,926,097 A * 12/1975 Santa Maria et al. ..... 493/361
4,417,516 A * 11/1983 Fischer ..... 101/181
5,024,128 A 6/1991 Campbell, Jr.
5,520,383 A 5/1996 Amagai et al.
5,641,156 A 6/1997 Nukada et al.
5,695,105 A * 12/1997 Ohara ..... 225/96
5,794,927 A 8/1998 Uchida
6,170,371 B1 1/2001 Cote et al.
6,170,820 B1 1/2001 Hutson
6,687,570 B1 2/2004 Sussmeier et al.
6,761,676 B2 7/2004 Wingate et al.
6,817,604 B2 * 11/2004 Ohlmann et al. ..... 270/5.02
2003/0033915 A1 2/2003 Glemser et al.

* cited by examiner

*Primary Examiner* — Patrick Mackey
(74) *Attorney, Agent, or Firm* — Davidson, Davidson & Kappel, LLC

(57) ABSTRACT

A printing press folder is provided. The folder includes a cutting pair cutting a web at a cutting location to form signatures, a pair of transport cylinders forming a first nip and a pair of acceleration cylinders forming a second nip. The pair of transport cylinders receives the signatures downstream of the cutting pair at the first nip and transports the signatures away from the cutting pair. The first nip is separated from the cutting location by a first distance. The pair of acceleration cylinders receives the signatures from the pair of transport cylinders at the second nip and transports the signatures away from the pair of transport cylinders. The second nip is separated from the first nip by a second distance. The pair of transport cylinders is movable with respect to the pair of acceleration cylinders and the pair of acceleration cylinders is movable with respect to the pair of transport cylinder so the first distance and the second distance are selectively variable. A signature transport section and a method of transporting signatures of varying lengths in a printing press are also provided.

19 Claims, 1 Drawing Sheet

SECTION FOR TRANSPORTING PRINTED PRODUCTS OF VARIABLE CUTOFFS IN A PRINTING PRESS FOLDER

The present invention relates generally to printing presses, and more particularly to a section for transporting printed products of variable cutoffs in a printing press.

BACKGROUND OF THE INVENTION

U.S. Pat. No. 5,103,703 discloses a sheet cutting apparatus for severing a rapidly-moving web, such as printed paper, into cut sheets in two stages. In the first stage, spaced cuts are made along a transverse cutting line of the web. The web is trained between belts which support the cut portions of the web, and the uncut portions of the web are severed to separate sheets. The sheets are conveyed out of the cutting station and into further apparatus. Preferably, the belts for supporting the web during the second cutting operation are trained around the knife and anvil rolls which make the cuts. The purpose of the belts is to prevent the leading edge of the web or a cut sheet from being projected forward of its support, thus tending to become dog-eared or misfed. The cuts made at the first and second cutting stations can be arranged in various patterns to remedy mis-timing of the respective cutting stations.

U.S. Pat. No. 5,695,105 discloses an apparatus for cutting a web at a predetermined length and supplying the same. A cutting roller is provided on its peripheral surface with projecting cutting blades arranged at predetermined intervals circumferentially and extending axially out of the cutting roller. The cutting blades are pressed against the peripheral surface of the receiving roller so as to cut the portion of the web which has passed between the cutting and receiving rollers at a predetermined length. At the downstream side of the cutting means there is provided accelerating means which has a pair of accelerating rollers sandwiching the web and sending the web in the transporting direction at a speed slightly higher than the speed which the cutting means provides.

U.S. Pat. No. 6,761,676 discloses a tape transport system for printed products comprising a first tape, a pulley supporting the tape, and a lever arm supporting the pulley, the lever arm including a first side rail and a second side rail, the pulley supported rotatably between the first and second side rails to form a narrow mechanism.

SUMMARY OF THE INVENTION

A printing press folder is provided. The folder includes a cutting pair cutting a web at a cutting location to form signatures, a pair of transport cylinders forming a first nip and a pair of acceleration cylinders forming a second nip. The pair of transport cylinders receives the signatures downstream of the cutting pair at the first nip and transports the signatures away from the cutting pair. The first nip is separated from the cutting location by a first distance. The pair of acceleration cylinders receives the signatures from the pair of transport cylinders at the second nip and transports the signatures away from the pair of transport cylinders. The second nip is separated from the first nip by a second distance. The pair of transport cylinders is movable with respect to the pair of acceleration cylinders and the pair of acceleration cylinders is movable with respect to the pair of transport cylinder so the first distance and the second distance are selectively variable.

A signature transport section is also provided. The signature transport section includes a first pair of cylinders forming a first nip, the first pair of cylinders receiving signatures at the first nip, and a second pair of cylinders forming a second nip. The second pair of cylinders receives signatures from the first pair of cylinders at the second nip at a first velocity and releases the signatures at a second velocity. The first nip and the second nip are separated by a nip distance that is selectively variable as a function of a length of the signatures.

A method of transporting signatures of varying lengths in a printing press is also provided. The method includes the steps of separating a first pair of cylinders forming a first nip and a second pair of cylinders forming a second nip by a first nip distance as a function of a first cutoff length, transporting a first signature of the first cutoff with the first pair of cylinders and the second pair of cylinders, separating the first pair of cylinders and the second pair of cylinders by a second nip distance as a function of a second cutoff length and transporting a second signature of the second cutoff with the first pair of cylinders and the second pair of cylinder.

BRIEF DESCRIPTION OF THE DRAWINGS

The present invention is described below by reference to the following drawings, in which.

DETAILED DESCRIPTION

In the web offset printing process, a continuous web of paper is transported through a printing press. Near the beginning of the press, one or more printing units apply ink to the web to repeatedly create a pattern, or impression, of text and images. A slitter may slit the web into ribbons, which may be longitudinally folded by a former. For the purposes of the present application, the term web also includes ribbons. A web conversion machine, such as a folder, may be used to cut the web into signatures and fold the signatures.

Many folders use driven belts or tapes to transport signatures from a cut cylinder to a next operation, such as signature deceleration or folding. These tapes contact the web before the signature is created and have a surface velocity higher than a velocity of the web. The tapes may mark the web or smear the text and images printed on the web.

After a signature is created by the cut cylinder, the signature may be accelerated by the tapes from the velocity of the web to the surface velocity of the tapes. The difference between the velocity of the web to the velocity of the tapes, the velocity gain, may be up to 16%. The velocity gain may cause the signature to slip in relation to the tapes. The amount of slip may be dependent upon a number of variables, including tape contact pressure, thickness of the signature, whether the signature has a glossy or matte finish, the amount of ink and silicone coverage, or the condition of the tapes.

The rate of signature acceleration may depend on the mass of the signatures and on the normal force and coefficient of friction between the tapes and signatures. These factors may cause position variations in the signatures when they reach the next device, such as a fan or jaw cylinder. Slipping may cause position variations, which can include: signature-to-signature variation at a given press speed, variations due to press speed changes, and variations due to tape wear over time. Position variations may cause the following problems: reduced maximum allowable press speed, increased need for manual phase adjustments, machine damage, and press downtime due to jammed signatures. Such problems may be worse in variable cutoff applications and may become worse as press speeds increase.

Effects of varying friction may be controlled by minimizing a distance between the cut cylinder and the tapes and by adding an adjustable "S" wrap roll configuration.

Figure 1:
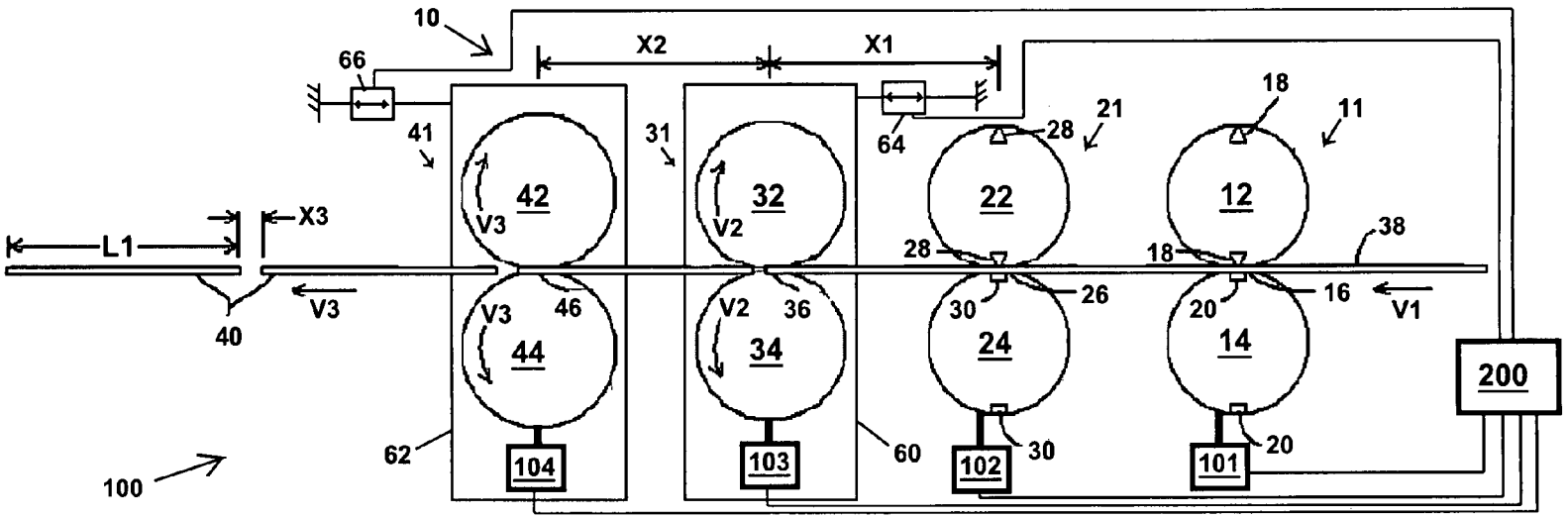
FIG. 1 shows a schematic side view of a printing press folder according to an embodiment of the present invention including a signature transport section transporting signatures of a first cutoff length.

FIG. 1 shows a schematic side view of a portion of a folder 100 of a printing press according to an embodiment of the present invention including a signature transport section 10 transporting signatures 40 of a first cutoff length L1. Signature transport section 10 includes transport pair 31 and acceleration pair 41, which transport signatures 40 created by cutting pairs 11, 21. Cutting pairs 11, 21 include respective cutting cylinders 12, 22 and respective anvil cylinders 14, 24, that perform a double cut on web 38 to create signatures 40.

Cutting cylinder 12 includes knives 18 that are segmented and partially cut, or perforate, web 40 by contacting anvils 20 on anvil cylinder 14 at a cutting location 16 between cylinders 12, 14. Cutting cylinder 22 includes knives 28 that finish the partial cuts by knives 18, forming signatures 40, by contacting anvils 30 on anvil cylinder 24 at a cutting location 26 between cylinders 22, 24. Knives 28 may also be segmented. Cylinders 12, 14 are phased with respect to cylinders 22, 24 to create signatures 40 of length L1. Cylinders 12, 14 may be driven by a motor 101 and cylinders 22, 24 may be driven by a motor 102. Motors 101, 102 may be servomotors.

Transport pair 31 includes transport cylinders 32, 34 and acceleration pair 41 includes acceleration cylinders 42, 44. Pairs 31, 41 contact signatures 40 at nips 36, 46, respectively, and positively grip signatures 40 as pairs 31, 41 transport signatures away from cutting pairs 11, 21. Transport pair 31 may be located in relation to cutting pair 21 such that cutting location 26 and nip 36 are separated by a distance X1, which is equal to or slightly less than a length L1 of each signature 40. Thus, before cutting cylinder 22 cuts web 38, forming one signature 40, transport pair 31 engages web 38 at nip 36 and applies tension to web 38.

Cylinders 32, 34 of transport pair 31 are rotated by a motor 103 so that each cylinder 32, 34 has a surface velocity V2, which is equal to or slightly faster than velocity V1 of web 38. Surface velocity V2 may be adjusted to optimize web tension for cutting. Transport pair 31 engages each signature 40 and passes each signature 40 to transport pair 41 at a velocity equal to surface velocity V2. Transport pair 31 may be located in relation to acceleration pair 41 such that nips 36, 46 are separated by a distance X2, which is substantially equal to length L1 of each signature 40. Thus, cylinders 42, 44 receive signatures 40 just as signatures 40 are being released by cylinders 32, 34.

Cylinders 42, 44 of acceleration pair 41 are rotated by a motor 104 so that each cylinder 42, 44 has a surface velocity V3, which is greater than surface velocity V2. Acceleration pair 41 engages each signature 40, accelerates each signature 40, and passes each signature 40 away from transport section 10 for further processing, for example folding. Acceleration pair 41 accelerates signatures 40 to provide a head to tail distance X3 between consecutive signatures 40. Head to tail distance X3 may be optimized by adjusting velocity V3. Surface velocity V3 may be equal to a speed at which signatures 40 will be transported during the further processing. In one embodiment, signatures 40 may then be delivered by acceleration pair 41 to transport tapes and carried by transport tapes away from nip 46. In another embodiment, signatures 40 may be carried away by grippers.

Each transport cylinder 32, 34, 42, 44 may be covered with an elastomeric material.

Pairs 31, 41 and may be mounted on respective frames 60, 62. Motors 103, 104 may also be mounted on frames 60, 62, respectively. Actuators 64, 66 may be provided to move frames 60, 62, respectively, back and forth in directions parallel to a direction of travel of web 38. As shown in FIG. 1, actuators 64, 66 have positioned frames 60, 62, respectively, such that nips 36, 46 are separated by distance X2 and nip 36 and cutting location 26 are separated by distance X1. The distance between nips 36, 46 and the distance between nip 36 and cutting location 26 may be adjusted so that signature transport section 10 may accommodate signatures of varying cutoff lengths. A controller 200 may be provided to control actuators 64, 66 and thus the distance between nips 36, 46 and the distance between cutting location 26 and nip 36. Controller 200 may also control motors 101, 102, 103, 104 to adjust the length of signatures created by cutting pairs 11, 21 and the velocities of cylinders 32, 34, 42, 44.

Guide belts may be provided to assist in guiding signatures through signature transport section 10. The guide belts may be provided in circumferential cutouts spaced axially in cylinders 22, 24, 32, 34, 42, 44.

In an alternative embodiment, frames 60, 62 may be manually actuated.

Figure 2:
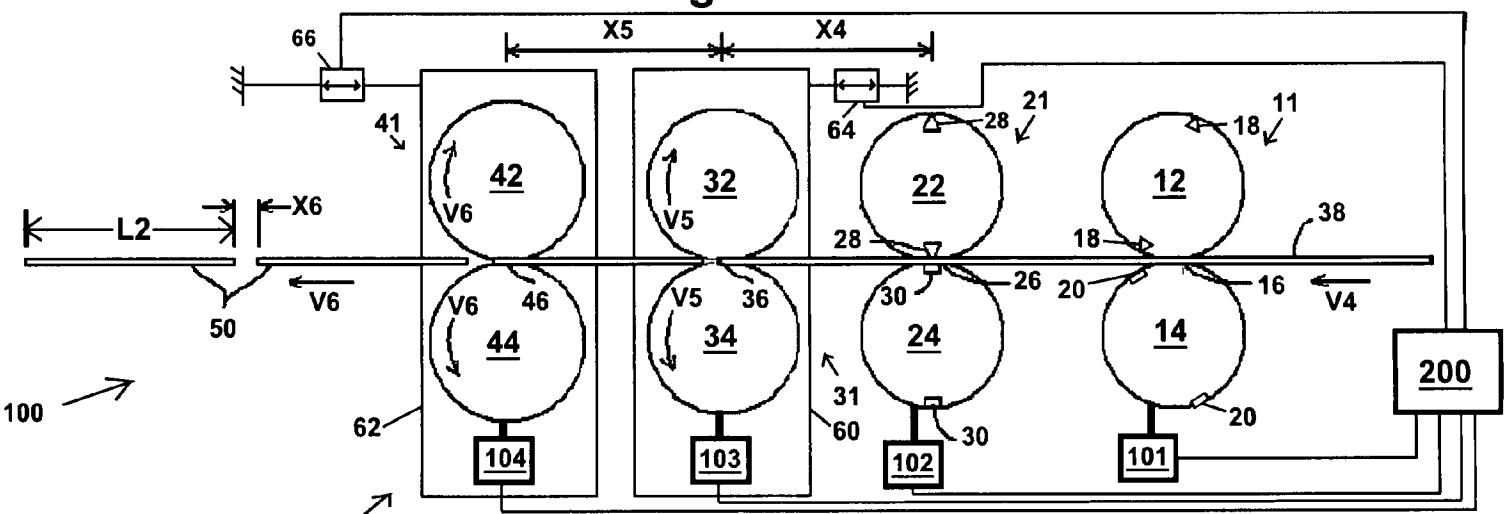
FIG. 2 shows a schematic side view of the signature transport section shown in FIG. 2 transporting signatures of a second cutoff length.

FIG. 2 shows signature transport section 10 transporting signatures 50 of a second cutoff length L2 that is shorter than cutoff length L1 of signatures 40 shown in FIG. 1. To accommodate signatures 50 of length L2, frames 60, 62 are actuated so that nips 36, 46 are separated by a distance X5, which is less than distance X2 (FIG. 1), and cutting location 26 and nip 36 are separated by a distance X4, which is less than distance X1 (FIG. 1). In a preferred embodiment, operations of the printing press and the folder are stopped to change the distances between nips 36, 46 and to adjust cutting pairs 11, 21 to create signatures of the desired length.

Signatures 50 are created by cylinders 12, 14, 22, 24. Cylinders 12, 14 are phased with respect to cylinders 22, 24 such that signatures 50 are of a smaller cutoff length L2 than signatures 40 (FIG. 1). Cylinders 12, 14, 22, 24 may be rotated at varying velocities during each revolution so that printed signatures 50 may vary in length from signatures 40 (FIG. 1). Other techniques of variable double cut signature formation may also be used.

Transport pair 31 is located in relation to cutting pair 21 such that cutting location 26 and nip 36 are separated by a distance X4, which may be equal to or slightly less than a cutoff length L2 of each signature 50. Thus, before cutting cylinder 22 cuts web 38, forming signature 50, transport pair 31 engages web 38 at nip 36 and applies tension to web 38.

Cylinders 32, 34 of transport pair 31 are rotated by motor 103 so that each cylinder 32, 34 has a surface velocity V5, which is equal to or faster than velocity V4 of web 38. Transport pair 31 engages each signature 50 and passes each signature 50 to acceleration pair 41 at velocity equal to surface velocity V5. Transport pair 31 may be located in relation to acceleration pair 41 such that nips 36, 46 are separated by a distance X5, which is substantially equal to length L2 of each signature 50. Thus, cylinders 42, 44 may receive signatures 50 just as signatures 50 are being released by cylinders 32, 34.

Cylinders 42, 44 of acceleration pair 41 are rotated by motor 104 so that each cylinder 42, 44 has a surface velocity V6, which is greater than surface velocity V5. Acceleration pair 41 engages each signature 50, accelerates each signature 50, and passes each signature 50 away from transport section 10 for further processing, for example folding. Transport pair 41 accelerates signatures 50 to provide a head to tail distance X6 between consecutive signatures 50. Head to tail distance X6 may be optimized by adjusting velocity V6.

Frames 60, 62 may also be actuated by actuators 64, 66, respectively, so that signature transport section 10 may be adjusted to set the distance between nips 36, 46 and the distance between cutting location 26 and nip 36 to accommodate signatures of cutoff lengths that are greater than cutoff lengths L1 (FIG. 1), L2.

In alternative embodiments, pairs 31, 41 are not mounted on frames 60, 62 and the positioning of pairs 31, 41 may be adjusted by other mechanisms. For example, shafts of cylinders 32, 34, 42, 44 may be moved in supporting slots to vary the distance between nips 36, 46 and the distance between nip 36 and cutting location 26. The adjustment of the distances between nips 36, 46 and the distance between nip 36 and cutting location 26 during a change in printing format advantageously allows signature transport section 10 to transport signatures of various lengths and allows signature transport section 10 to be used in variable cutoff printing presses.

In another alternative embodiment, signatures 40 are delivered by nip 46 into an additional nip formed by an additional cylinder acceleration pair. The additional nip would further accelerate signatures 40 to further increase head to tail distance X6.

In the preceding specification, the invention has been described with reference to specific exemplary embodiments and examples thereof. It will, however, be evident that various modifications and changes may be made thereto without departing from the broader spirit and scope of invention as set forth in the claims that follow. The specification and drawings are accordingly to be regarded in an illustrative manner rather than a restrictive sense.

What is claimed is:

1. A printing press folder comprising:

a cutting pair cutting a web at a cutting location to form signatures;

a pair of transport cylinders forming a first nip, the pair of transport cylinders receiving the signatures downstream of the cutting pair at the first nip and transporting the signatures away from the cutting pair, the first nip being separated from the cutting location by a first distance; and a pair of acceleration cylinders forming a second nip, the pair of acceleration cylinders receiving the signatures from the pair of transport cylinders at the second nip and transporting the signatures away from the pair of transport cylinders, the second nip being separated from the first nip by a second distance, the pair of transport cylinders being movable with respect to the pair of acceleration cylinders and the pair of acceleration cylinders being movable with respect to the pair of transport cylinders so the first distance and the second distance are selectively variable.

2. The printing press folder recited in claim 1 further comprising a first frame supporting the pair of transport cylinders and a second frame supporting the pair of acceleration cylinders.

3. The printing press folder recited in claim 1 further comprising a first actuator and a second actuator, the first actuator moving the pair of transport cylinders to selectively vary the first distance and the second distance and the second actuator moving the pair of acceleration cylinders to selectively vary the second distance.

4. The printing press folder recited in claim 3 further comprising a controller controlling the first actuator and the second actuator as a function of a length of the signatures being transported by the pair of transport cylinders and the pair of acceleration cylinders.

5. The printing press folder recited in claim 1 further comprising a second cutting pair upstream of the cutting pair, the second cutting pair perforating the web.

6. The printing press folder recited in claim 1 wherein the pair of acceleration cylinders receive the signatures from the pair of transport cylinders at a first velocity and accelerate the signatures to a second velocity.

7. The printing press folder recited in claim 1 wherein the first distance is slightly less or equal to a length of the signatures being transported by the pair of transport cylinders and the pair of acceleration cylinders.

8. The printing press folder recited in claim 1 the second distance is equal to the length of the signatures being transported by the pair of transport cylinders and the pair of acceleration cylinders.

9. A signature transport section comprising:

a first pair of cylinders forming a first nip, the first pair of cylinders receiving signatures at the first nip; and a second pair of cylinders forming a second nip, the second pair of cylinders receiving signatures from the first pair of cylinders at the second nip at a first velocity and releasing the signatures at a second velocity, the first nip and the second nip being separated by a nip distance that is selectively variable as a function of a length of the signatures.

10. The signature transport section recited in claim 9 further comprising a first frame supporting the first pair of cylinders and a second frame supporting the second pair of cylinders.

11. The signature transport section recited in claim 9 further comprising a first actuator and a second actuator, the first actuator moving the first pair of cylinders and the second actuator moving the second pair of cylinders to selectively vary the nip distance.

12. The signature transport section recited in claim 11 further comprising a controller controlling the first actuator and the second actuator to vary the nip distance as a function of a length of the signatures being transported by the first pair of cylinders and the second pair of cylinders.

13. The signature transport section recited in claim 9 further comprising a first motor and a second motor, the first motor rotating the first pair of cylinders so the first pair of cylinders have a surface velocity equal to the first velocity and the second motor rotating the second pair of cylinders so the second pair of cylinders have a surface velocity equal to the second velocity.

14. The signature transport section recited in claim 9 wherein the first distance is slightly less or equal to a length of the signatures being transported by the first and second pairs of cylinders and the second distance is slightly less or equal to the length of the signatures being transported by the first and second pairs of cylinders.

15. A method of transporting signatures of varying lengths in a printing press comprising:

separating a first pair of cylinders forming a first nip and a second pair of cylinders forming a second nip by a first nip distance as a function of a first cutoff length;

transporting a first signature of the first cutoff with the first pair of cylinders and the second pair of cylinders;

separating the first pair of cylinders and the second pair of cylinders by a second nip distance as a function of a second cutoff length; and transporting a second signature of the second cutoff with the first pair of cylinders and the second pair of cylinder.

16. The method as recited in claim 15 wherein the step of transporting the first signature includes:

engaging the first signature with the first pair of cylinders at the first nip;

releasing the first signature from the first nip to the second nip; and engaging the first signature with the second pair of transport cylinders at the second nip and accelerating the first signature.

17. The method as recited in claim 15 wherein the first nip distance is greater than the second nip distance.

18. The method as recited in claim 15 wherein the second nip distance is greater than the first nip distance.

19. The method as recited in claim 15 further comprising:

stopping operation of the printing press before separating the first pair of cylinders and the second pair of cylinders by the second nip distance; and restarting operation of the printing press before transporting the second signature of the second cutoff.

* * * * *